US010107007B2

(12) United States Patent
Kim

(10) Patent No.: US 10,107,007 B2
(45) Date of Patent: Oct. 23, 2018

(54) ELECTRONIC LOCKING DEVICE

(71) Applicant: Bum Soo Kim, Namyangju-si (KR)

(72) Inventor: Bum Soo Kim, Namyangju-si (KR)

( * ) Notice: Subject to any disclaimer, the term of this patent is extended or adjusted under 35 U.S.C. 154(b) by 141 days.

(21) Appl. No.: 15/100,609

(22) PCT Filed: Jul. 31, 2015

(86) PCT No.: PCT/KR2015/008073
§ 371 (c)(1),
(2) Date: May 31, 2016

(87) PCT Pub. No.: WO2016/068459
PCT Pub. Date: May 6, 2016

(65) Prior Publication Data

US 2016/0298359 A1 Oct. 13, 2016

(30) Foreign Application Priority Data

Oct. 29, 2014 (KR) ..... 10-2014-0148324

(51) Int. Cl.

| | |
|---|---|
| ***E05B 11/00*** | (2006.01) |
| ***E05B 9/04*** | (2006.01) |
| ***E05B 47/06*** | (2006.01) |
| ***E05C 3/04*** | (2006.01) |

(Continued)

(52) U.S. Cl.
CPC ..... *E05B 11/00* (2013.01); *E05B 9/04* (2013.01); *E05B 47/063* (2013.01); *E05C 3/042* (2013.01); *E05B 47/0012* (2013.01); *E05B 49/00* (2013.01); *E05B 2047/002* (2013.01); *E05B 2047/0025* (2013.01); *E05B 2047/0067* (2013.01)

(58) Field of Classification Search
CPC ..... E05B 11/00; E05B 9/04; E05B 47/063; E05B 47/0012; E05B 49/00; E05B 47/002; E05B 2047/0025; E05B 2047/0067; E05C 3/042
USPC ..... 70/278.3
See application file for complete search history.

(56) References Cited

U.S. PATENT DOCUMENTS 4,798,068 A * 1/1989 Nakauchi ..... E05B 47/063 70/276
4,854,146 A * 8/1989 O'Connell ..... E05B 17/04 70/277

(Continued)

FOREIGN PATENT DOCUMENTS

JP 4188691 B2 11/2008
KR 10-2006-0027757 A 3/2006

(Continued)

OTHER PUBLICATIONS

Boneham and Turner Limited "Spring Loaded Ball Lock Pins" Oddicroft Industrial Estate, Oddicrfoft Lane Sutton-in-Ashfield NG17-5FS United Kingdom, established 1918.

*Primary Examiner* — Suzanne L Barrett
(74) *Attorney, Agent, or Firm* — Novick, Kim & Lee, PLLC; Sang Ho Lee

(57) ABSTRACT

The present invention relates to an electronic locking device. In accordance with one embodiment of the present invention, a structure capable of supporting and fixing a key head of an electronic key is formed at a lock head of a cylinder plug such that it may prevent the electronic key not only from being easily escaped from the cylinder plug but also from being lost.

7 Claims, 7 Drawing Sheets

(51) Int. Cl.
*E05B 49/00* (2006.01)
*E05B 47/00* (2006.01)

(56) References Cited

U.S. PATENT DOCUMENTS

| | | | | | |
|---|---|---|---|---|---|
| 4,953,375 | A * | 9/1990 | Tzou | E05B 45/10 | 70/419 |
| 5,507,162 | A * | 4/1996 | Chhatwal | E05B 17/22 | 340/5.64 |
| 8,276,414 | B2 * | 10/2012 | Luo | E05B 47/063 | 70/256 |
| 8,720,238 | B1 * | 5/2014 | Davis | E05B 43/005 | 70/278.7 |
| 9,803,393 | B2 * | 10/2017 | Chow | E05B 47/0611 | |
| 2016/0281389 | A1 * | 9/2016 | Chow | E05B 47/0611 | |

FOREIGN PATENT DOCUMENTS

| | | | |
|---|---|---|---|
| KR | 10-0732879 | B1 | 6/2007 |
| KR | 10-1016903 | B1 | 2/2011 |
| KR | 10-1237738 | B1 | 2/2013 |

* cited by examiner

ELECTRONIC LOCKING DEVICE

TECHNICAL FIELD

The present invention relates to an electronic locking device.

BACKGROUND

Generally, a locking device is installed at drawers, furniture and the like of home, a public building, and various storing instruments, gates, lockers, facilities and the like of a commercial building to establish security.

The locking device for such security is classified into a mechanical locking device and an electronic locking device. In the case of the mechanical locking device, there are problems with a security issue by means of a master key and with a replacement of a locking device when a key is lost.

To address these problems of the mechanical locking device, technology for an electronic locking device using an electronic key has been developed.

As an example of such an electronic locking device, 'a cylinder-type electronic locking device' is disclosed in Korean Registered Patent No. 10-1016903.

The cylinder-type electronic locking device disclosed, however, is not provided with a separate fixing structure between a key insertion hole of an electronic key and an insertion portion of a locking device when the electronic key is inserted into the locking device to be operated, such that there is a problem in which the electronic key is escaped from the locking device to be lost, which is caused when a door is opened or a closed by a user while the user inserts the electronic key into the locking device.

DISCLOSURE

Technical Problem

Therefore, the present invention is provided to form a structure capable of supporting and fixing a key head of an electronic key at a lock head of a cylinder plug, thereby preventing the electronic key not only from being easily escaped from the cylinder plug but also from being lost.

The object of the present invention is not limited to the described above, and other objects not described may be apparently understood from the following description by those skilled in the art.

Technical Solution

To achieve the object described above, one embodiment of the present invention provides an electronic locking device including a cylinder housing configured to form an external appearance, and a cylinder plug arranged inside the cylinder housing, installed to be rotatable at an original position, and locked or unlocked in the cylinder housing, wherein the cylinder plug includes a key contact point pin into which a key head of an electronic key is attachably and detachably inserted and configured to come in contact with a terminal of the key head, and a lock head at which a second supporter corresponding to a first supporter formed at the key head is formed to fixedly support the electronic key.

Advantageous Effects

In accordance with one embodiment of the present invention, a structure capable of supporting and fixing the key head of the electronic key is formed at the lock head of the cylinder plug such that it may prevent the electronic key not only from being easily escaped from the cylinder plug but also from being lost.

DESCRIPTION DRAWINGS

Figure 1:
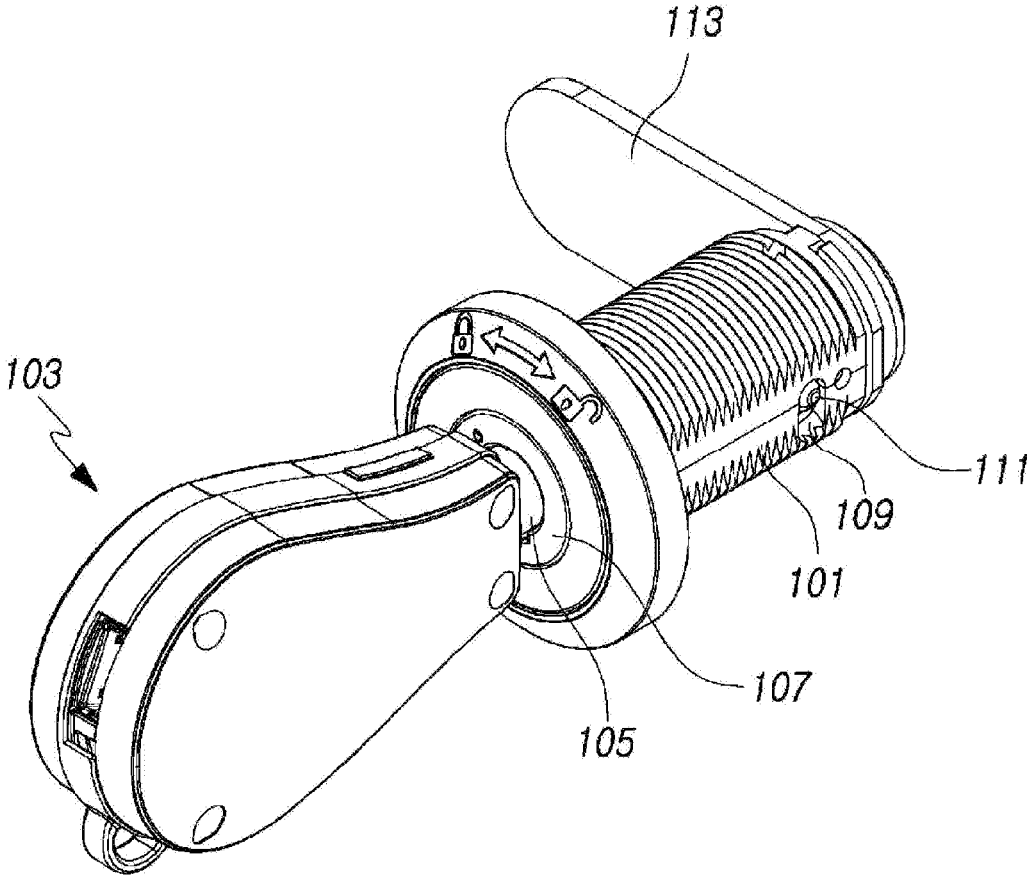
FIG. 1 is a perspective view illustrating a coupled status of an electronic locking device and an electronic key according to one embodiment of the present invention.

* Description of Major Reference Numerals in the Drawings *

| | |
|---|---|
| 101: Cylinder Housing | 103: Electronic Key |
| 105: Key Head | 107: Lock Head |
| 109: Fixing Hole | 111: Lock Pin |
| 113: Latch Bolt | 201: Key Contact Point Pin |
| 203: First Supporter | 205: Second Supporter |
| 207: Key Insertion Hole | 301: Cylinder Plug |
| 303: Head | 305: Guide Shaft |
| 307: Elastic Member | 309: Controller |
| 311: Driver | 313: Direction Change Rotation Ring |
| 315: Movement Shaft | 401: Switcher |
| 501: Switch | 503: Head Portion |
| 505: Extended Leg Portion | 507: Support Leg Portion |
| 509: Elastic Support Member | 601: Spiral Recessed Groove |
| 701: Insertion Hole | 703: Driving Shaft |
| 705: Spur Gear | |

MODES OF THE INVENTION

Hereinafter, some embodiments of the present invention will be described in detail with reference to the accompanying illustrative drawings. In giving reference numerals to components of the drawings, it should be noted that the same components have the same reference numerals as possible although being shown in different drawings. Also, in the following description of the present invention, if a detailed description of known functions and configurations is determined to obscure the gist of embodiments of the present invention, the detailed description thereof will be omitted.

Further, in explaining the components of the embodiment of the present invention, a first, a second, A, B, (a), (b), and the like can be used. These terms are intended to distinguish one component from other components, but the nature and the order or sequence of the components is not limited by those terms. When components are disclosed as "connected," "coupled" or "contacted" to other components, the component can be directly connected or contacted to the other components, but it should be understood that another component(s) could be "connected," "coupled" or "contacted" therebetween.

Figure 2:
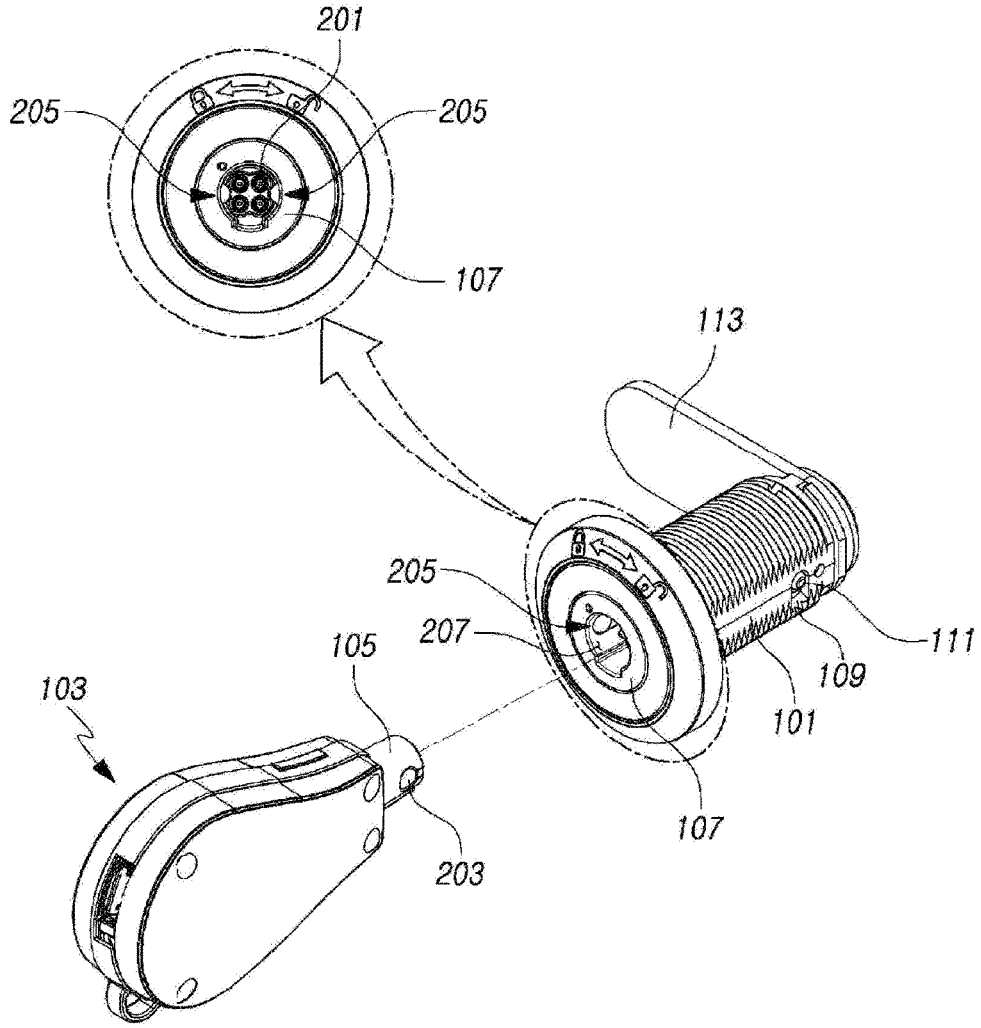
FIG. 2 is a perspective view illustrating a separated status of the electronic locking device and the electronic key according to one embodiment of the present invention.
Figure 3:
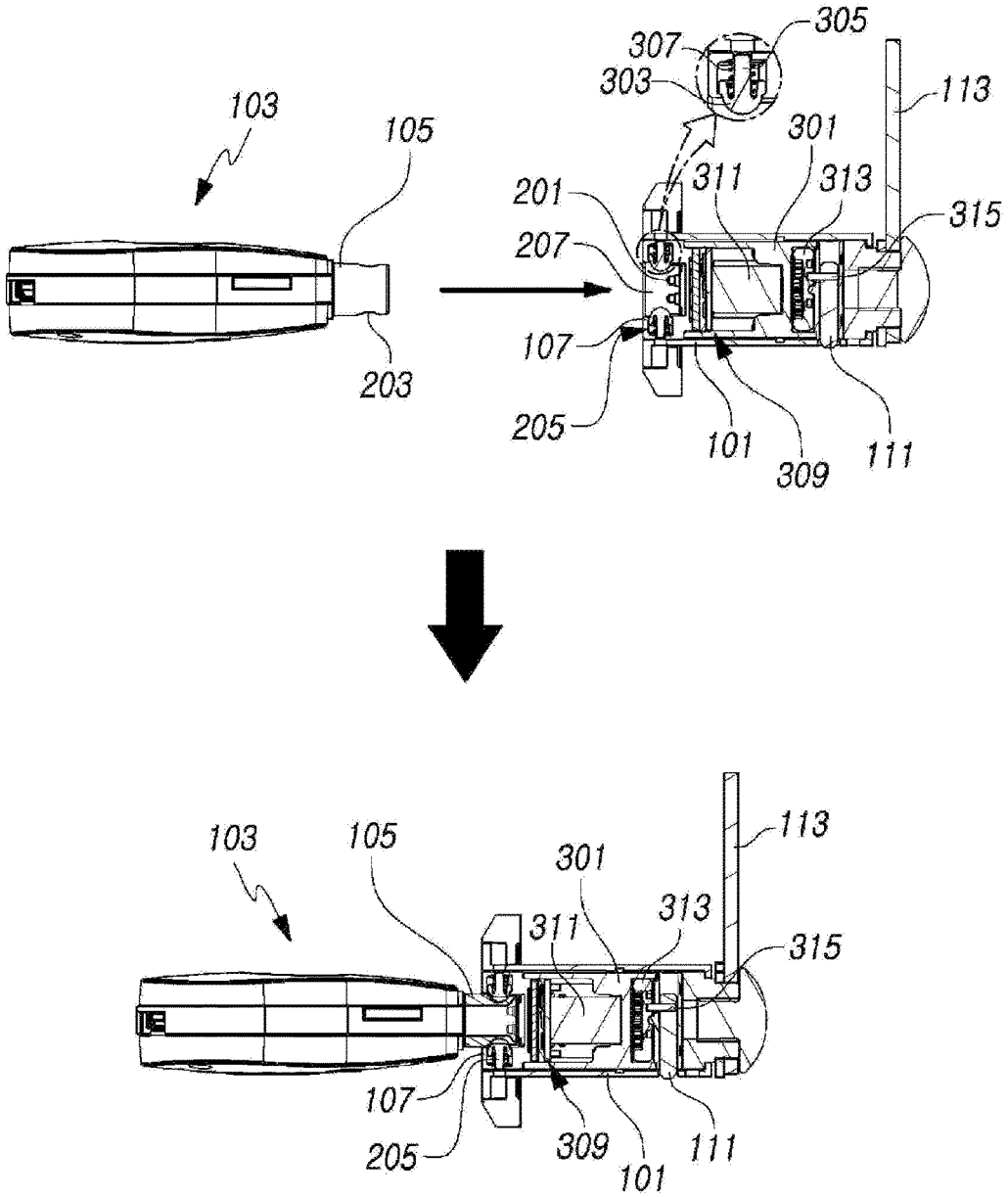
FIG. 3 is a cross-sectional view of a part of FIGS. 1 and 2.
Figure 4:
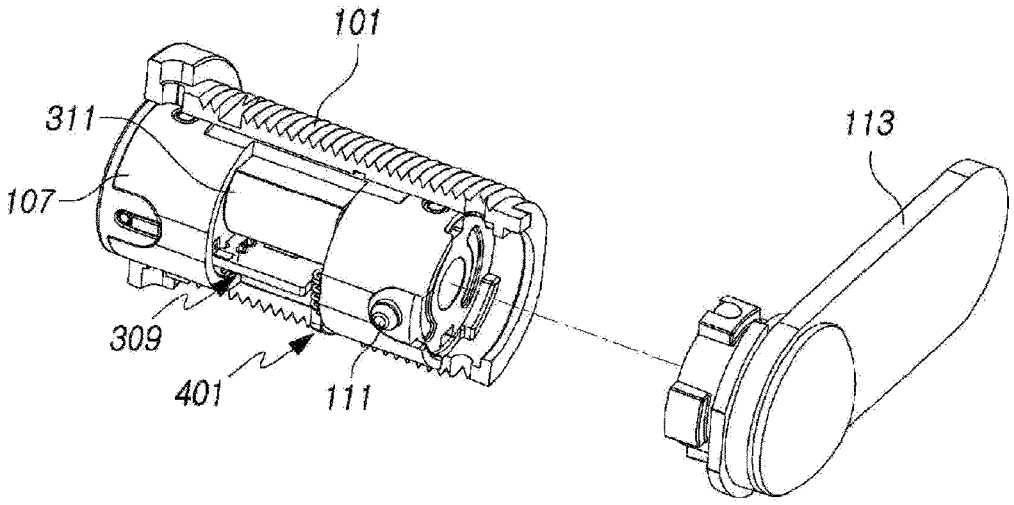
FIG. 4 is an exploded perspective view illustrating a part of the electronic locking device according to one embodiment of the present invention.
Figure 5:
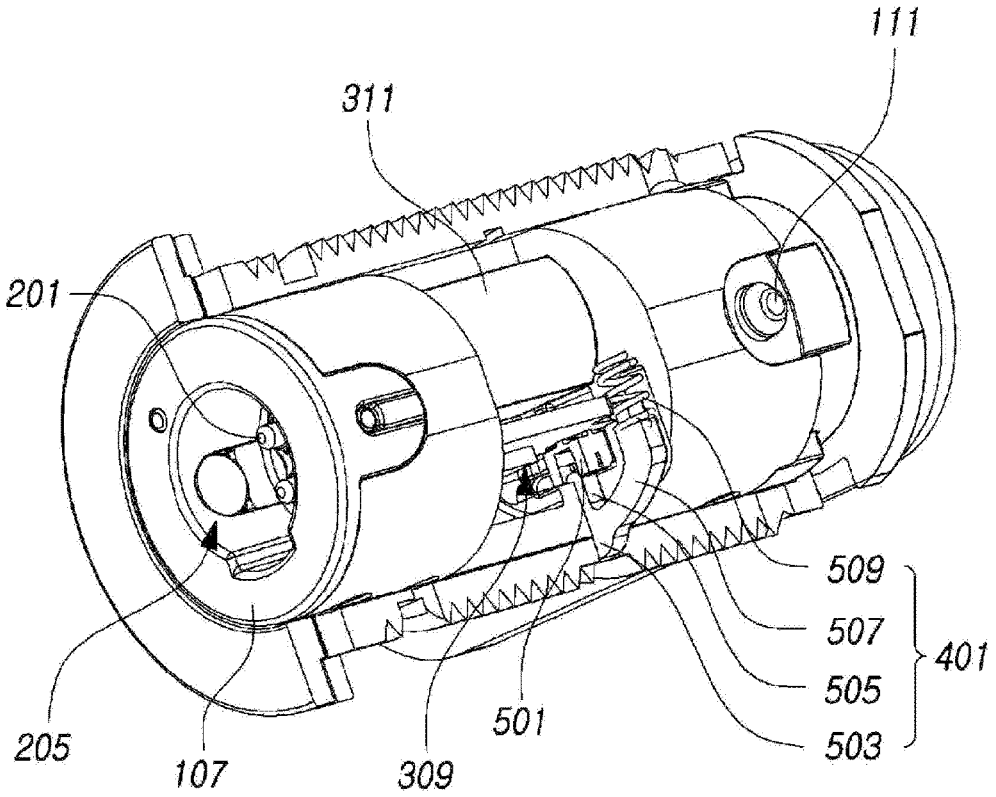
FIG. 5 is a partially cut-away perspective view illustrating a part of the electronic locking device according to one embodiment of the present invention.
Figure 6:
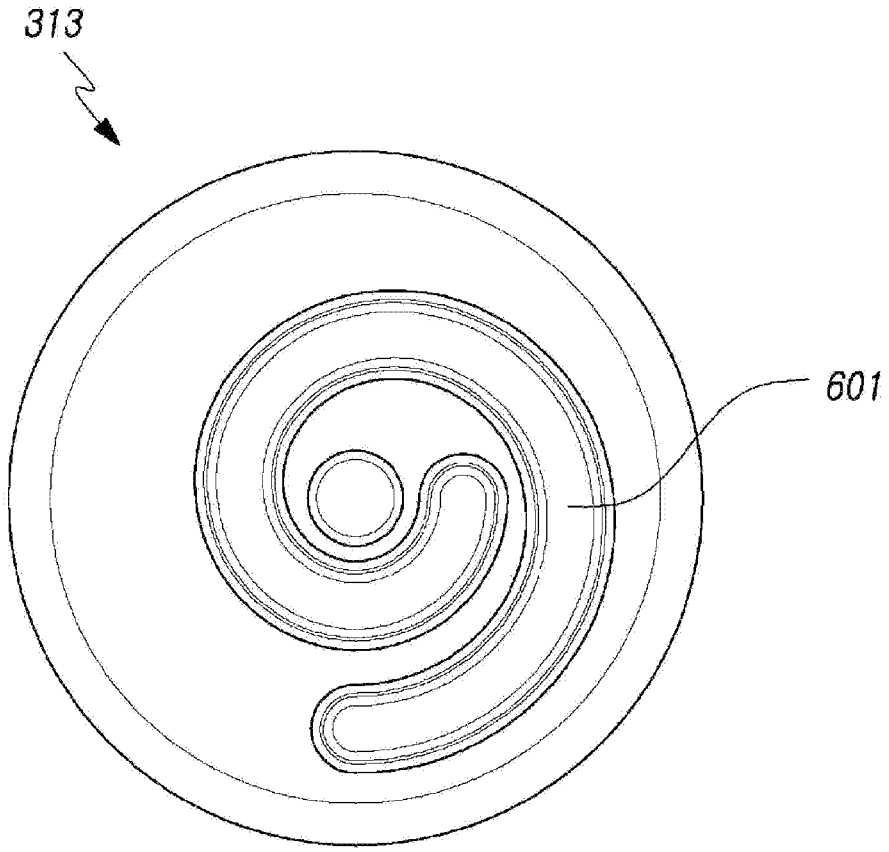
FIG. 6 is a view illustrating a direction change rotation ring of the electronic locking device according to one embodiment of the present invention.
Figure 7:
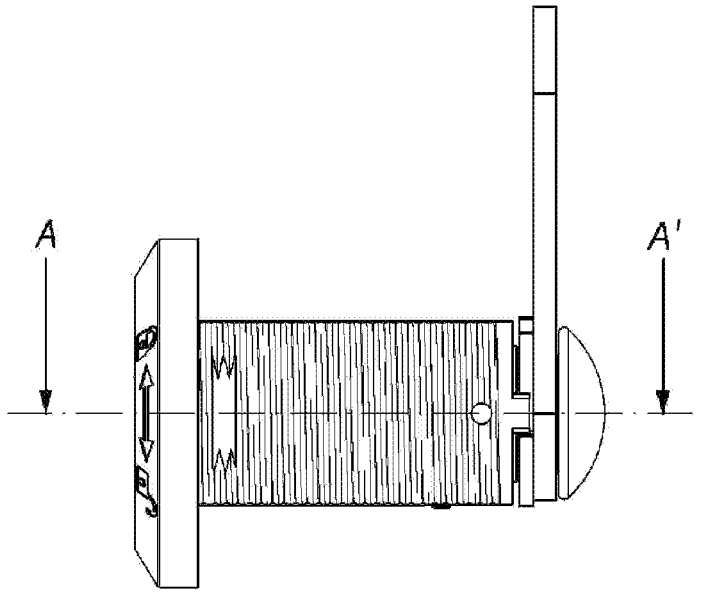
FIG. 7 is a cross-sectional view taken along line A-A' of the electronic locking device according to one embodiment of the present invention.
Figure 7:
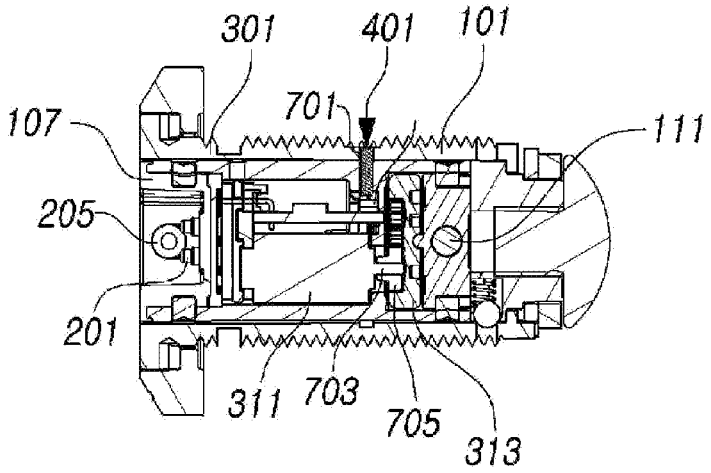

FIG. 1 is a perspective view illustrating a coupled status of an electronic locking device and an electronic key according to one embodiment of the present invention. FIG. 2 is a perspective view illustrating a separated status of the electronic locking device and the electronic key according to one embodiment of the present invention. FIG. 3 is a cross-sectional view of a part of FIGS. 1 and 2. FIG. 4 is an exploded perspective view illustrating a part of the electronic locking device according to one embodiment of the present invention. FIG. 5 is a partially cut-away perspective view illustrating a part of the electronic locking device according to one embodiment of the present invention. FIG. 6 is a view illustrating a direction change rotation ring of the electronic locking device according to one embodiment of the present invention. FIG. 7 is a cross-sectional view taken along line A-A' of the electronic locking device according to one embodiment of the present invention.

As shown in these drawings, an electronic locking device according to one embodiment of the present invention includes a cylinder housing 101 forming an external appearance and a cylinder plug 301, wherein the cylinder plug 301 is located inside the cylinder housing 101, is installed to be rotatable at an original position, and is locked or unlocked in the cylinder housing 101. The cylinder plug 301 includes a key contact point pin 201 into which a key head 105 of an electronic key 103 is attachably and detachably inserted and configured to come in contact with a terminal of the key head 105, and a lock head 107 at which a second supporter 205 corresponding to a first supporter 203 formed at the key head 105 is formed to fixedly support the electronic key 103.

The cylinder housing 101 is provided in, for example, a hollow cylindrical shape to form an external appearance of a locking device. Screw threads are formed on an outer circumferential surface of the cylinder housing 101 to be screw-coupled to a coupling hole formed at a door and the like.

In addition, the cylinder plug 301 is located inside the cylinder housing 101 and is installed to be rotatable at the original position. The cylinder plug 301 is locked or unlocked in the cylinder housing 101, and a latch bolt 113 is coupled to the cylinder plug 301 to be rotated together according to a rotation thereof.

Meanwhile, such a cylinder plug 301 includes the key contact point pin 201 into which the key head 105 of the electronic key 103 is attachably and detachably inserted and configured to come in contact with the terminal of the key head 105, and the lock head 107 at which the second supporter 205 corresponding to the first supporter 203 formed at the key head 105 is formed to fixedly support the electronic key 103.

In other words, a key insertion hole 207 into which the key head 105 of the electronic key 103 is attachably and detachably inserted is formed at the lock head 107 provided at the cylinder plug 301, and a plurality of key contact point pins 201 are provided at a bottom surface (that is, a surface opposite to an opening direction) of the key insertion hole 207 to come in contact with the terminal (not shown) of key head 105 when the key head 105 of the electronic key 103 is inserted into the key insertion hole 207, so that an electric power and authentication data are transmitted from the electronic key 103 to the cylinder plug 301.

Meanwhile, the second supporter 205 is formed at the lock head 107. Such a second supporter 205 corresponds to the first supporter 203 formed at the key head 105 of the electronic key 103 to fixedly support the key head 105 inserted into the key insertion hole 207.

By describing examples of configurations of the first supporter 203 and the second supporter 205 in more detail, the first supporter 203 is formed with a concavely recessed groove at an outer circumferential surface of the key head 105, and the second supporter 205 is provided at an edge surface of the key insertion hole 207 into which the key head 105 is inserted, and corresponds to the first supporter 203 and may be formed of a protrusion to be elastically supported.

That is, the second supporter 205 may be provided to have a structure in which a head 303 exposed to an outside at a circumferential surface of the key insertion hole 207 is formed to be rounded and an elastic member 307 is coupled to an outer circumference side of a guide shaft 305 integrally extended from the head 303.

Consequently, when the key head 105 is inserted into the key insertion hole 207, the head 303 of the second supporter 205 is pressed and then projected by an elastic restoring force of the elastic member 307 to pressurize and support the first supporter 203 of the key head 105, such that the electronic key 103 is not easily escaped from the cylinder plug 301.

Alternatively, formation objects of the first supporter 203 and the second supporter 205 described above may be exchanged with each other. In other words, the first supporter 203 may be provided at the outer circumferential surface of the key head 105 in the form of a protrusion to be elastically supported, and the second supporter 205 may be formed at the edge surface of the key insertion hole 207 into which the key head 105 is inserted in the form of a concavely recessed groove so as to correspond to the first supporter 203.

Meanwhile, the cylinder plug 301 may include a controller 309 electrically connected to the key contact point pin 201 to receive the electric power and the authentication data from the electronic key 103, a switcher 401 configured to come in contact with a switch 501 provided at the controller 309 according to a rotation of the cylinder plug 301 to transmit a contact signal to the controller 309, a driver 311 configured to receive a control signal output from the controller 309 in response to the contact signal to rotate in a forward direction or in a reverse direction, and a lock pin 111 inserted into and withdrawn from a fixing hole 109 of the cylinder housing 101 according to an operation of the driver 311 to control a rotation and a non-rotation of the cylinder plug 301.

The controller 309 is electrically connected to the key contact point pin 201 to receive the electric power and the authentication data from the electronic key 103. In other words, the controller 309 receives the electric power from the electronic key 103 to control a supplying of the electric power to the driver 311 to be described, and also receives the authentication data from the electronic key 103 to compare the received authentication data with prestored user authentication data, thereby determining whether or not the electronic key 103 is an authenticated key.

Additionally, the switch 501 is provided at the controller 309 to transmit a control signal to the driver 311, when coming in contact with the switcher 401 to be described.

With a rotation of the cylinder plug 301, the switcher 401 comes in contact with the switch 501 provided at the controller 309 to transmit a contact signal thereto.

By describing an example of a structure of such a switcher 401 in more detail, the switcher 401 may include a head portion 503 inserted into and arranged at an insertion hole 701 formed at the cylinder housing 101, an extended leg portion 505 extended from the head portion 503 so as to come in contact with the switch 501 when the head portion 503 is pressed according to a rotation of the cylinder plug 301, a support leg portion 507 integrally formed with the extended leg portion 505 and the head portion 503 to one side or both sides of the extended leg portion 505, and an elastic support member 509 having one end coupled to the support leg portion 507 and the other end supported by an inward side of the cylinder plug 301.

As described above, because the switcher 401 coming in contact with the switch 501 provided at the controller 309 to transmit the contact signal thereto is provided, the key head 105 of the electronic key 103 is inserted into the key insertion hole 207 of the lock head 107 and the terminal of the key head 105 comes in contact with the key contact point pin 201 of the lock head 107, so that the authentication data of the electronic key 103 is transmitted to the controller 309. Under the condition that the electronic key 103 is determined as an authenticated key, when the switcher 401 is pressed according to a rotation of the cylinder plug 301 in one direction and the contact signal representing a contact of the switcher 401 and the switch 501 is transmitted to the controller 309, the controller 309 transmits the control signal to and activates the driver 311 to withdraw the lock pin 111 to be described below from the fixing hole 109 of the cylinder housing 101 and to enable the cylinder plug 301 to be rotated, thereby unlocking the electronic locking device.

Thereafter, the driver 311 receives the control signal output from the controller 309 in response to the contact signal generated by the contact of the switch 501 and the switcher 401 to rotate in a forward direction or in a reverse direction, wherein the driver 311 may be provided as an electric motor, for example.

And, the lock pin 111 is inserted into or withdrawn from the fixing hole 109 of the cylinder housing 101 according to an activation of the driver 311 to control a rotation and a non-rotation of the cylinder plug 301.

Meanwhile, by describing an operating structure of the lock pin 111 according to the activation of the driver 311 in more detail, a spur gear 705 is coupled to a driving shaft 703 of the driver 311, and a movement shaft 315 including an internal gear formed at one side thereof so as to be in engagement with the spur gear 705 being off-centered and a direction change rotation ring 313 formed at the other side thereof and on which a spiral recessed groove 601 is formed is provided such that one end of the movement shaft 315 is inserted into the spiral recessed groove 601 and the other end thereof is coupled to the lock pin 111. With such a configuration, when the driving shaft 703 is rotated in a forward direction or in a reverse direction according to the activation of the driver 311, the direction change rotation ring 313 is rotated in one direction or the other direction and thus the movement shaft 315 moves along the spiral recessed groove 601 of the direction change rotation ring 313, such that the lock pin 111 is advanced or moved backward (that is, the lock pin 111 is inserted into or withdrawn from the fixing hole 109 of the cylinder housing 101) to control a rotation or a non-rotation of the cylinder plug 301 inside the cylinder housing 101.

As described above, in accordance with one embodiment of the present invention, a structure capable of supporting and fixing the key head of the electronic key is formed at the lock head of the cylinder plug such that it may prevent the electronic key not only from being easily escaped from the cylinder plug but also from being lost.

Heretofore, even though all components configuring the embodiments of the present invention are described to be combined as one unit or to operate as a combination thereof, the present invention is not limited to these embodiments. That is, within the scope of the present invention, all components may be selectively combined to one or more thereof to operate as a combination.

Also, the terms of "comprise," "configure" and/or "have" specify the presence of stated components, unless there is a clearly different meaning in the present application, but do not preclude the presence thereof and should be construed to further include other components. Unless otherwise defined, all terms including technical or scientific terms used herein have the same meaning as commonly understood by those skilled in the art to which the invention pertains. General terms like those defined in a dictionary shall be construed to have meanings that are consistent in the context of the relevant art, and will not be interpreted as having an idealistic or excessively formalistic meaning unless clearly defined in the present application.

Although the embodiments have been described with reference to a number of illustrative embodiments thereof, it should be understood that numerous other modifications and embodiments can be devised by those skilled in the art that will fall within the spirit and scope of the principles of this disclosure. The embodiments disclosed herein, therefore, are not to be taken in a sense for limiting the technical concept of the present invention but for explanation thereof, and the range of the technical concept is not limited to these embodiments. The scope of the present invention should be construed by the appended claims, along with the full range of equivalents to which such claims are entitled.

The invention claimed is:

1. An electronic locking device comprising:

a cylinder housing configured to form an external appearance; and a cylinder plug arranged inside the cylinder housing, installed to be rotatable at an original position, and locked or unlocked in the cylinder housing, wherein the cylinder plug includes:

a key contact point pin into which a key head of an electronic key is attachably and detachably inserted and configured to come in contact with a terminal of the key head;

a lock head at which a second supporter corresponding to a first supporter formed at the key head is formed to fixedly support the electronic key;

a controller electrically connected to the key contact point pin and configured to receive an electric power and authentication data from the electronic key;

a switcher configured to come in contact with a switch provided at the controller according to a rotation of the cylinder plug to transmit a contact signal to the controller;

a driver configured to receive a control signal output from the controller in response to the contact signal to rotate in a forward direction or a reverse direction; and a lock pin configured to be inserted into or withdrawn from a fixing hole of the cylinder housing according to an activation of the driver to control a rotation and a non-rotation of the cylinder plug, and wherein the switcher includes:

a head portion inserted into and arranged at an insertion hole formed at the cylinder housing;

an extended leg portion extended from the head portion and being in contact with the switch when the head portion is pressed by the cylinder housing according to a rotation of the cylinder plug;

a support leg portion integrally formed with the extended leg portion and the head portion and extended from one side or both sides of the extended leg portion; and an elastic support member configured to have one end coupled to the support leg portion and the other end supported by an inward side of the cylinder plug.

2. The electronic locking device of claim 1, wherein the first supporter is provided at an outer circumferential surface of the key head in the form of a concavely recessed groove, and the second supporter is provided at an edge surface of a key insertion hole into which the key head is inserted, and corresponds to the first supporter and is provided in the form of a protrusion being elastically supported.

3. The electronic locking device of claim 1, wherein the first supporter is provided at an outer circumferential surface of the key head and formed with a protrusion being elastically supported, and the second supporter is formed at an edge surface of a key insertion hole into which the key head is inserted in the form of a concavely recessed groove so as to correspond to the first supporter.

4. The electronic locking device of claim 1, wherein the extended leg portion is integrally extended from the head portion, and a structure of the extended leg portion and the head portion is elongated in a first direction perpendicular to a widthwise direction of the switch.

5. The electronic locking device of claim 4, wherein one end of the support leg portion is extended from the structure of the extended leg portion and the head portion and extended in a second direction, the second direction is different from the first direction.

6. The electronic locking device of claim 5, wherein the one end of the support leg portion is bent.

7. The electronic locking device of claim 5, wherein the one end of the support leg portion is coupled to the elastic support member, and the elastic support member is elongated in a third direction, wherein the first direction and the third direction are in a parallel direction with a distance.

* * * * *